US009365270B2

(12) United States Patent
Lee

(10) Patent No.: US 9,365,270 B2
(45) Date of Patent: Jun. 14, 2016

(54) INFLATOR

(71) Applicant: William Lee, Taipei (TW)

(72) Inventor: William Lee, Taipei (TW)

( * ) Notice: Subject to any disclaimer, the term of this patent is extended or adjusted under 35 U.S.C. 154(b) by 325 days.

(21) Appl. No.: 14/177,787

(22) Filed: Feb. 11, 2014

(65) Prior Publication Data

US 2015/0225048 A1 Aug. 13, 2015

(51) Int. Cl.
*B63C 9/19* (2006.01)
*B63C 9/15* (2006.01)

(52) U.S. Cl.
CPC .. *B63C 9/19* (2013.01); *B63C 9/155* (2013.01)

(58) Field of Classification Search
CPC ..... B63C 9/19; B63C 9/155
USPC ..... 141/329, 330; 441/93, 94; 280/741
See application file for complete search history.

(56) References Cited

U.S. PATENT DOCUMENTS 3,809,288 A * 5/1974 Mackal ..... B29C 45/14311 141/19
3,815,783 A * 6/1974 Hirata ..... F16K 15/20 222/5
4,498,604 A * 2/1985 Mackal ..... B63B 9/24 141/329
5,564,478 A * 10/1996 Weinheimer ..... B63B 9/24 141/19
5,643,030 A * 7/1997 Brown ..... B63C 9/24 116/277
5,694,986 A 12/1997 Weinheimer et al.
6,422,420 B1 7/2002 Brown
6,589,087 B2 * 7/2003 Mackal ..... B63C 9/18 222/5
7,475,711 B2 * 1/2009 Fawcett, Jr. ..... B63C 9/24 141/19
7,669,616 B2 * 3/2010 Bruengger ..... B63C 9/24 137/68.3
7,854,347 B2 * 12/2010 Wang ..... B63C 9/24 141/329
8,353,736 B2 * 1/2013 Wang ..... F04B 33/005 102/530
8,360,276 B2 * 1/2013 Rogier ..... B63C 9/18 137/227

* cited by examiner

*Primary Examiner* — Timothy L Maust
(74) *Attorney, Agent, or Firm* — Muncy, Geissler, Olds & Lowe, P.C.

(57) ABSTRACT

An inflator used for inflation of an object such as life jackets, life boats, etc is revealed. A needle-shaped shaft is driven by a transmission arm to pierce a seal of a gas cylinder on the inflator. Thus compressed gas in the gas cylinder is released and flowing through the inflator to inflate the object. The needle-shaped shaft is arranged with two color areas for representing state of the inflator. The color area is displayed through windows of the inflator to show the state now. The inflator features on simple structure, convenience in use, reduced cost and precise movement.

16 Claims, 17 Drawing Sheets

INFLATOR

BACKGROUND OF THE INVENTION

The present invention relates to an inflator, especially to an inflator that indicates state and having simple structure.

Generally, water life saving equipment including life jackets, life vests, life rafts, etc. is connected to an inflator with a high pressure gas cylinder for fast inflation and providing gas required for generating buoyancy. The conventional inflator at least includes an inflator body, a pierce pin arranged at and movable with the inflator body, and a rotation arm. While in use, the pierce pin is driven by the rotation arm to pierce a seal of the high pressure gas cylinder. Thus compressed gas in the gas cylinder is released so as to inflation the life saving equipment mentioned above. The inflator is further arranged with an indicator for indicating the state of the inflator and the state of the high pressure gas cylinder. Users can learn the state of the inflator and the gas cylinder.

Refer to U.S. Pat. No. 7,854,347, a manual gas inflator is revealed. The shortcoming of the manual gas inflator is in that CO2 sensor and CO2 gas cylinder need to be replaced at the same time during rearming process. Moreover, the structure of the manual gas inflator is complicated and many components required increase the cost. The CO2 sensor is a special component and is not easy to get.

Refer to U.S. Pat. No. 3,809,288, an inflation manifold assembly is disclosed. The disadvantage of the inflation manifold assembly is in that an additional component (such as a color indicator) is required besides replacement of the gas cylinder during the reaming process. Once the rearming process is interrupted or the color indicator is lost, whether the gas cylinder of the inflator has been used is unable to be confirmed. Thus the gas cylinder needs to be removed and checked again.

Refer to U.S. Pat. No. 5,694,986, an automatic actuator with apertured housing and safety indicator is revealed. The shortcoming of the device is in that during rearming of the inflator operated manually, additional component (such as color indicator) is required. Once the rearming process is interrupted or the color indicator is lost, whether the gas cylinder of the inflator has been used is unable to be checked. The gas cylinder needs to be removed and checked again. When the inflator is operated automatically and the color indicator is not fallen off, whether the gas cylinder is fully-charged is unable to be quickly checked by the appearance. The gas cylinder needs to be removed for checking the state.

Refer to U.S. Pat. No. 6,589,087, an automatic inflator having a status indicator is disclosed. Besides the gas cylinder, a cylinder adapter also needs to be replaced during rearming of the inflator. Thus the cost is increased. Moreover, the status indicator that indicates whether the gas cylinder has been installed has complicated structure. Thus the assembly is time-consuming and the cost is further increased.

As to the inflators revealed in U.S. Pat. No. 5,643,030, and U.S. Pat. No. 6,422,420, they have the same shortcoming. Both devices have movement structure that needs more components. Thus more assembly processes are required and the defective rate is increased. Therefore the cost of the product is increased.

Thus the conventional at least has following shortcomings: complicated structure, too many components, time-consuming assembly and additional components required during rearming of the inflator. Moreover, users are unable to quickly check whether the gas cylinder of the inflator is replaced or not yet during rearming of the inflator.

SUMMARY OF THE INVENTION

Therefore it is a primary object of the present invention to provide an inflator that not only overcomes shortcomings of conventional ones but also features on simple structure, reliable performance, easy operation, convenient rearming and reduced cost.

In order to achieve the above object, an inflator of the present invention includes an inflator body, a needle-shaped shaft and a transmission arm. A top surface of the inflator body is disposed with a cylinder housing for mounting a gas cylinder. The inflator body further includes a first channel and a chamber therein. A through hole for connecting an object to be inflated is arranged at a side surface of the inflator body. A top end and a bottom end of the first channel are communicating with the cylinder housing and the chamber respectively while the through hole is communicating with one side of the first channel. A window is arranged at each of the two opposite side surfaces of the inflator body respectively. The needle-shaped shaft is moveable in the first channel of the inflator body and including a needle on a top end and a spring and a movable seat are disposed on a lower part thereof in turn. The needle is for piercing a seal of the gas cylinder. A first color area and a second color area are disposed around the needle-shaped shaft vertically. Through the windows of the inflator body, the color of the first color area or the second color area is displayed to indicate the state of the inflator including a non-inflated state and an already-inflated state. The transmission arm is pivotally disposed on the chamber of the inflator body and one end of the transmission arm is leaning against the bottom surface of the movable seat.

While in use, the transmission arm is rotated counterclockwise to chive the movable seat moving upward and further compressing the spring. Then the needle-shaped shaft is further pushed to move upward for piercing the seal of the gas cylinder. Thus compressed gas in the gas cylinder is released, passed the first channel and the through hole of the inflator body and entering the object to be inflated for inflation. Now the color of the first color area of the needle-shaped shaft representing non-inflated state and displayed through the window of the inflator body is changed into the color of the second color area that represents already-inflated state. Next the transmission arm is released. Due to the elasticity, one end of the first spring is elastically against the bottom surface of the needle-shaped shaft to keep the needle stay on the seal while the other end of the first spring is elastically against the movable seat to make the movable seat move downward. Thus the transmission arm is rotated in the opposite direction and moved back to the original position.

DETAILED DESCRIPTION OF THE PREFERRED EMBODIMENT

Figure 1:
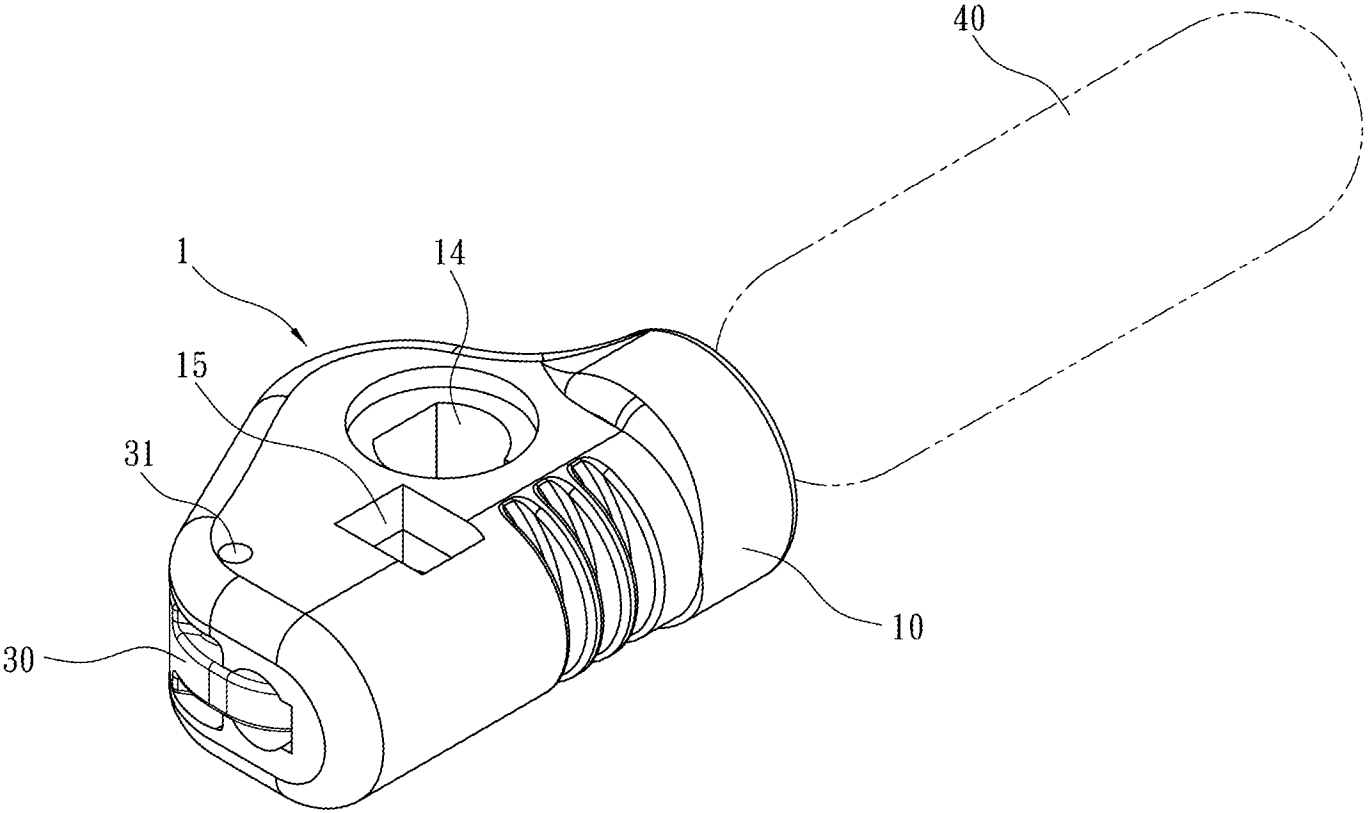
FIG. 1 is a perspective view of an embodiment according to the present invention.
Figure 2:
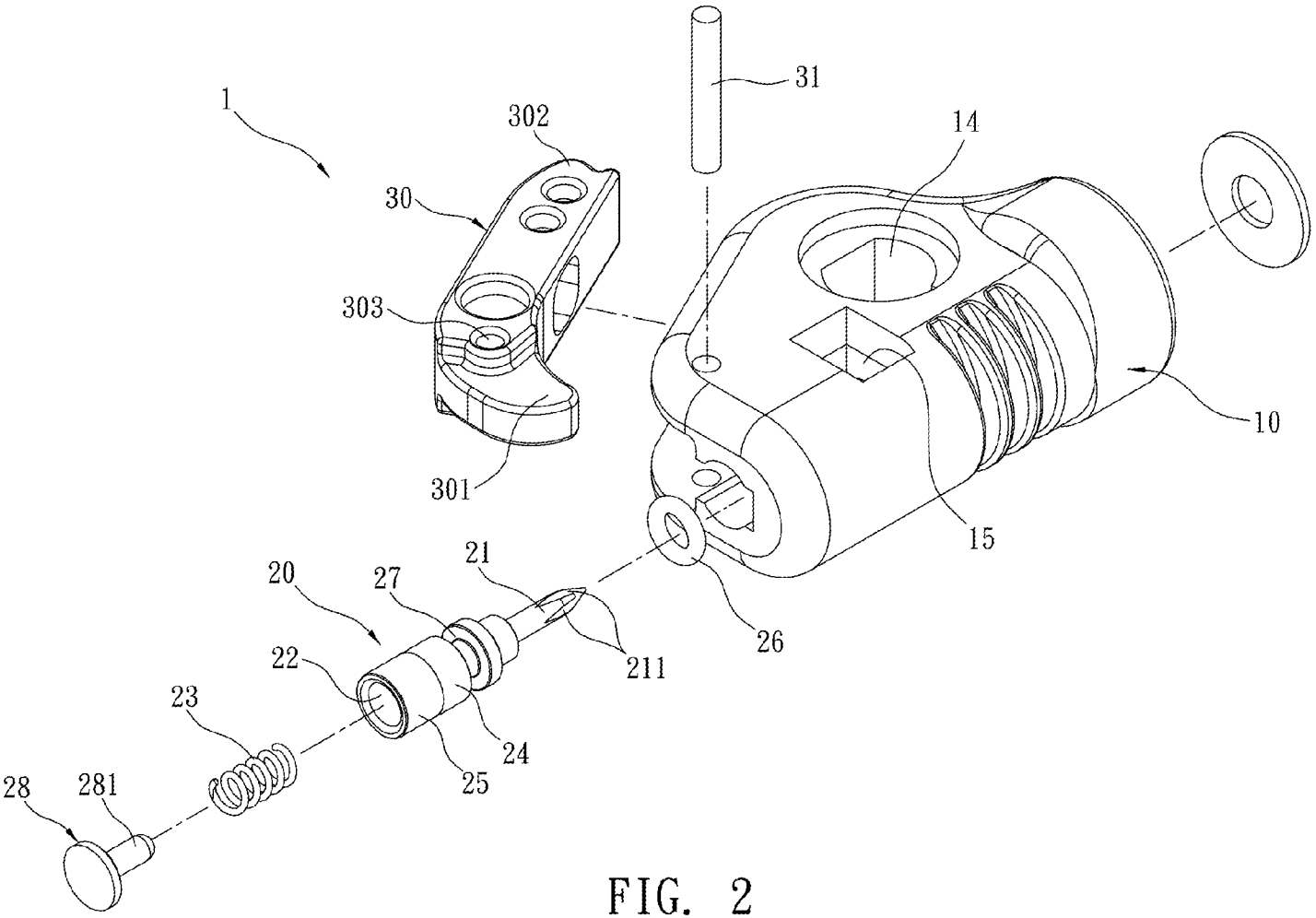
FIG. 2 is an explosive view of an embodiment according to the present invention.

Refer to FIG. 1 and FIG. 2, an inflator 1 of the present invention includes an inflator body 10, a needle-shaped shaft 20 and a transmission arm 30.

Figure 3A:
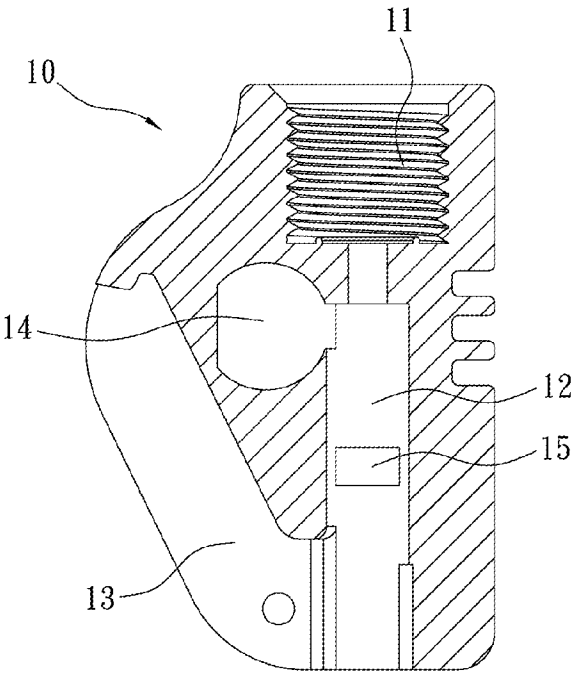
FIG. 3 and FIG. 3A are a front view and a front cross sectional view of an inflator body respectively of an embodiment according to the present invention.
Figure 3:
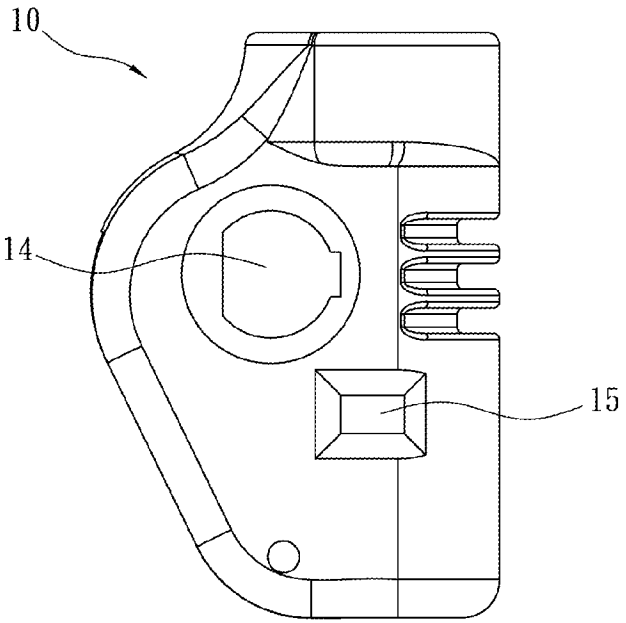

Refer to FIG. 3 and FIG. 3A, a cylinder housing 11 with an opening facing upward for mounting a gas cylinder 40 (such as CO2 cylinder) is disposed on a top surface of the inflator body 10. A seal 41 of the gas cylinder 40 is facing a bottom surface of the cylinder housing 11. The inflator body 10 further includes a long first channel 12, a chamber 13 therein, and a through hole 14 for connecting an object being inflated (not shown in figure) and located at a side surface thereof. A top end and a bottom end of the first channel 12 are communicating with the cylinder housing 11 and the chamber 13 respectively while the through hole 14 is communicating with one side of the first channel 12. A window 15 is arranged at a front surface and a rear surface of the inflator body 10 respectively. The two windows 15 are arranged symmetrically and corresponding to each other.

Refer from FIG. 4 to FIG. 8, the needle-shaped shaft 20 is mounted in the first channel 12 of the inflator body 10 and is moved along the length direction of the first channel 12. The needle-shaped shaft 20 includes a needle 21, a space 22 with an opening facing downward, a first spring 23, a first color area 24, a second color area 25, a seal ring 26, a groove 27, and a movable seat 28. The needle 21 is conical and arranged on a top end of the needle-shaped shaft 20 for piercing the seal 41 of the gas cylinder 40. The first color area 24 and the second color area 25 with different colors such as green and red are disposed around the needle-shaped shaft 20 and adjacent to each other. The first color area 24 and the second color area 25 are corresponding to the windows 15 of the inflator body 10 respectively at different time so as to show the color through the windows 15 for indicating the state of the inflator 1. The seal ring 26 is arranged around the needle-shaped shaft 20, between the needle 21 and the first color area 24 and mounted in the groove 27. The seal ring 26 is against an inner wall of the first channel 12 of the inflator body 12 so as to achieve sealing.

Figure 7:
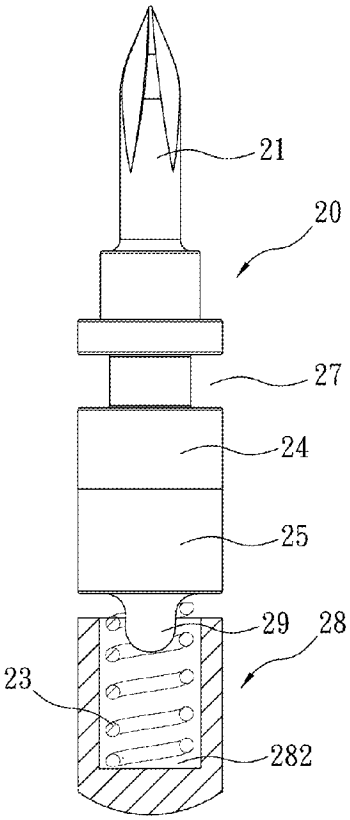
FIG. 7 is a schematic drawing showing the embodiment in FIG. 5 and FIG. 6 assembled with a spring according to the present invention.
Figure 6:
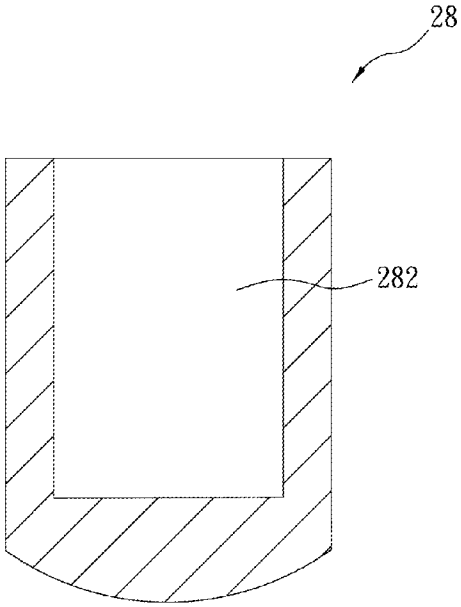
FIG. 6 is a front cross sectional view of a movable seat of an embodiment according to the present invention.
Figure 5:
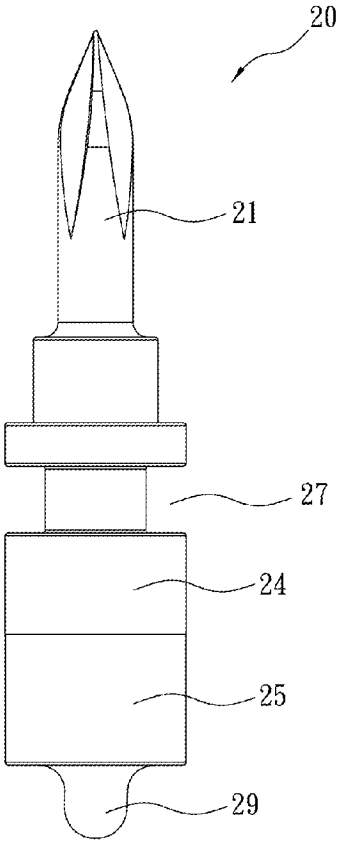
FIG. 5 is a front view of a needle-shaped shaft of another embodiment according to the present invention.

The first spring 23 and the movable seat 28 are disposed on a lower part of the needle-shaped shaft 20 in turn. The top end and the bottom end of the first spring 23 are leaning against the bottom surface of the needle-shaped shaft 20 and the top surface of the movable seat 28. A space 22 with an opening facing downward for receiving the first spring 23 is arranged at a lower end of the needle-shaped shaft 20 (as shown in FIG. 2). Or a protrusion 29 is projecting downward from the bottom surface of the needle-shaped shaft 20 to be mounted in the top end of the first spring 23, as shown in FIG. 5. Moreover, a projecting pin 281 is formed on a top surface of the moveable seat 28 to be mounted in the bottom end of the first spring 23. Or a space 282 with an opening facing upward for receiving the first spring 23 is arranged at the top surface of the movable seat 28, as shown in FIG. 6. The needle-shaped shaft 20 and the movable seat 28 are corresponding to each other and used in combination with each other. Refer to FIG. 7, another embodiment of an assembly including the needle-shaped shaft 20 with protrusion 29, the movable seat 28 having the space 282 and the first spring 23 according to the present invention is disclosed.

Figure 4B:
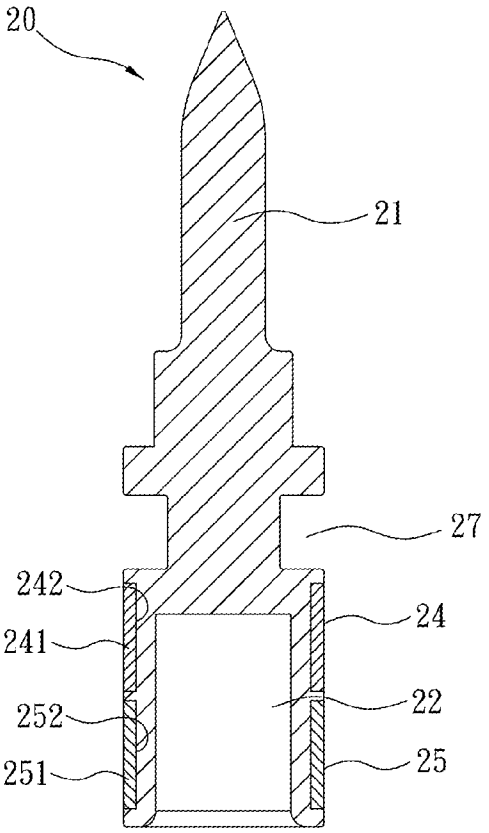
FIG. 4, FIG. 4A, and FIG. 4B are a front view, a cross sectional view of an embodiment and a cross sectional view of another embodiment respectively according to the present invention.
Figure 4A:
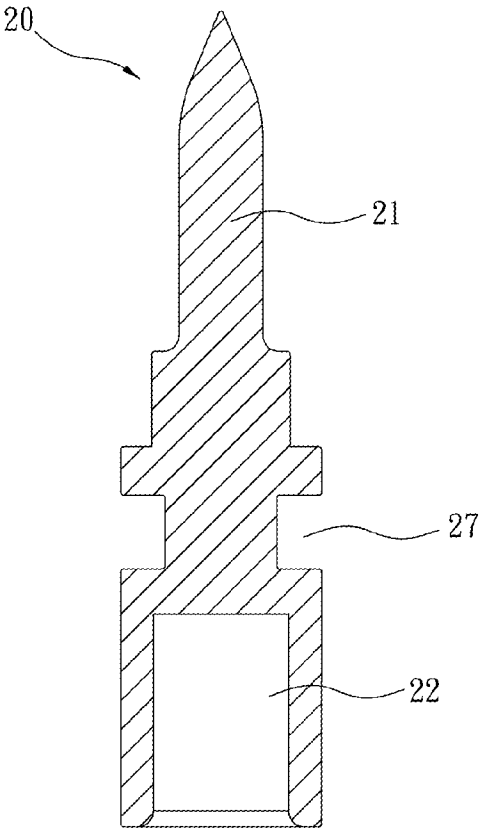
Figure 4:
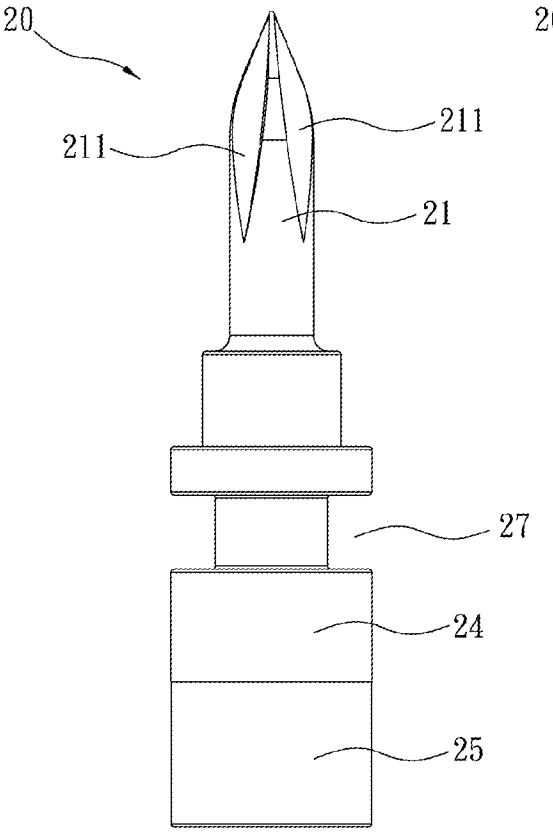

Refer to FIG. 2 and FIG. 4, at least one long slot 211 with one end extending toward a head end of the needle 21 is disposed on a surface of the needle 21 of the needle-shaped shaft 20. When there is a plurality of slots 211 on the needle 21, the slots 211 are arranged at a certain interval. Due to the conical shape, the needle 21 pierces a central area of the seal 41 of the gas cylinder 40 to form a regular round hole. The movement of the needle 21 will not be interfered by the round hole. By the long slots 211, the compressed gas in the gas cylinder 40 is released at a higher speed. In contrast, the hole formed by the conventional beveled needle tip piercing the seal 41 of the gas cylinder 40 is not located at the central area of the seal 41. Moreover, the edge of the hole is irregular so that the movement of the needle 21 into or out of the seal 41 of the gas cylinder 40 is interfered.

The colors of the first color area 24 and the second color area 25 of the needle-shaped shaft 20 are coated over the needle-shaped shaft 20 by spray, electroplating or coating. Refer to FIG. 4B, a first covering body 241 that represents the color of the first color area 24 and a second covering body 251 that represents the color of the second color area 25 are made by colored plastic respectively. The first covering body 241 and the second covering body 251 are covered around the needle-shaped shaft 20 or covered over a first concave area 242 and a second concave area 252 disposed on the needle-shaped shaft 20 and correspondingly to the first covering body 241 and the second covering body 251 respectively. By the coating techniques, the color on the above color area is not easy to fade. Thus the operation state is checked easily and the service life is increased.

Refer to FIG. 2, the transmission arm 30 includes a first end 301 at one end thereof, a second end 302 at the other end and a pivot hole 303 between the first end 301 and the second end 302. A pivot shaft 31 is passed through the pivot hole 303 so as to pivotally connect the transmission arm 30 to the chamber 13 of the inflator body 10. Thus the transmission arm 30 rotates around the pivot shaft 31. The first end 301 is against the bottom surface of the movable seat 28 while the second end 302 is operated to rotate the transmission arm 30.

When the needle-shaped shaft 20 pierces the seal 41 of the gas cylinder 40, the first spring 23 is compressed into the space 22 of the needle-shaped shaft 20 or the space 282 of the movable seat 28. At the moment, the top surface of the movable seat 28 is in contact with the bottom surface of the needle-shaped shaft 20 so as to prevent damages or elastic fatigue of the first spring 23 caused by over compression. Thereby the first spring 23 is protected by the design and the structure of the space 22, 282 mentioned above.

The first color area 24 is used to represent non-inflated state while the second color area 25 is represented the already-inflated state. When the gas cylinder 40 is assembled with the cylinder housing 11 of the inflator body 10, the needle-shaped shaft 20 is observed through the window 15. Once the color of the first color area 24 such as green color is shown, it is learned that the inflator 1 can be used for inflation or is full-charged after being used. If the color of the second color area 25 such as red color is displayed, it means that the inflator 1 is unable to be used. The gas cylinder 40 needs to be replaced or rearmed so that the inflator 1 can be used again.

Two windows 15 on the inflator body 10 of the present invention allow users to check the state of the inflator 1 now easier and faster, compared with conventional device with a single window 15.

Figure 9:
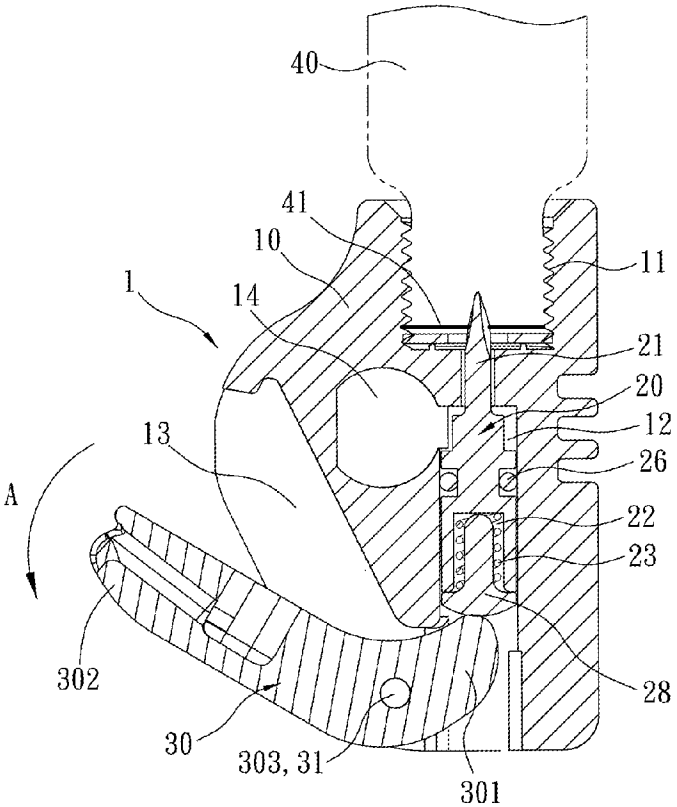
FIG. 8, FIG. 9 and FIG. 10 are cross sectional views showing how an embodiment works according to the present invention.
Figure 8:
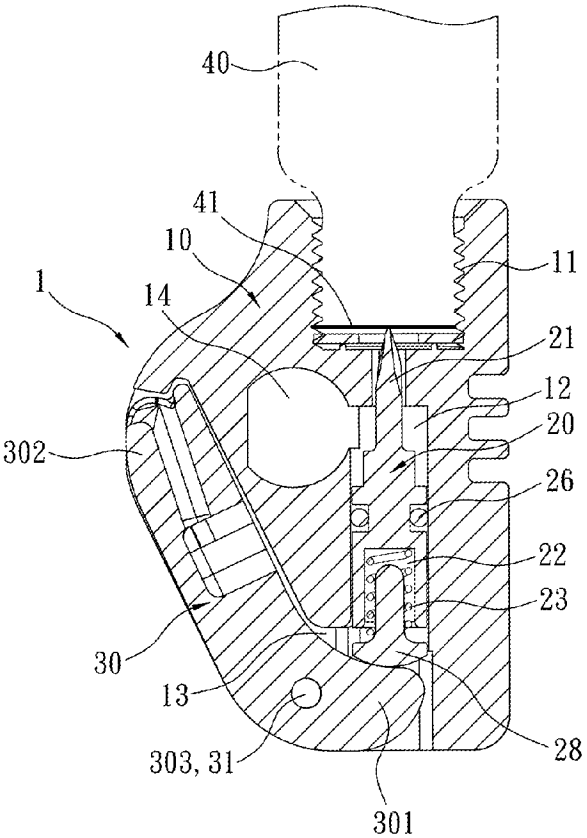
Figure 10:
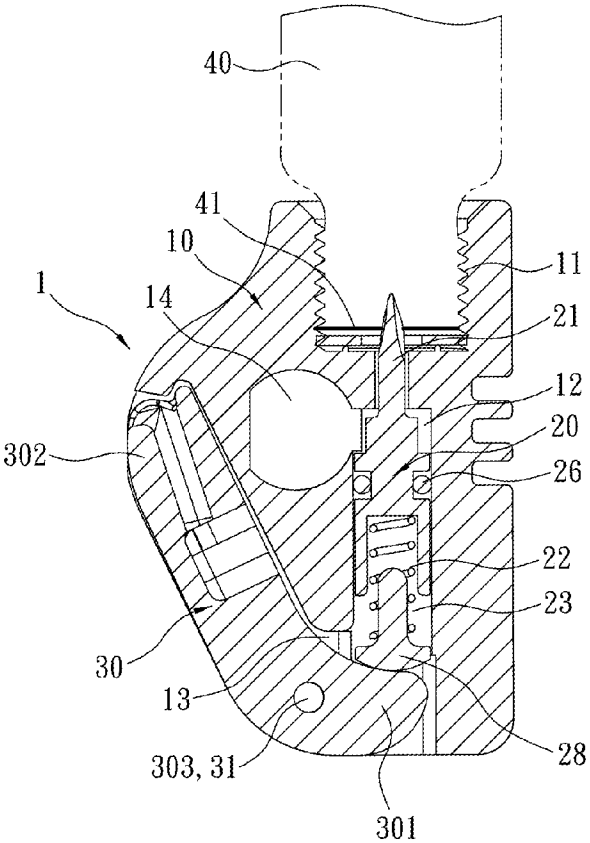
Figure 12:
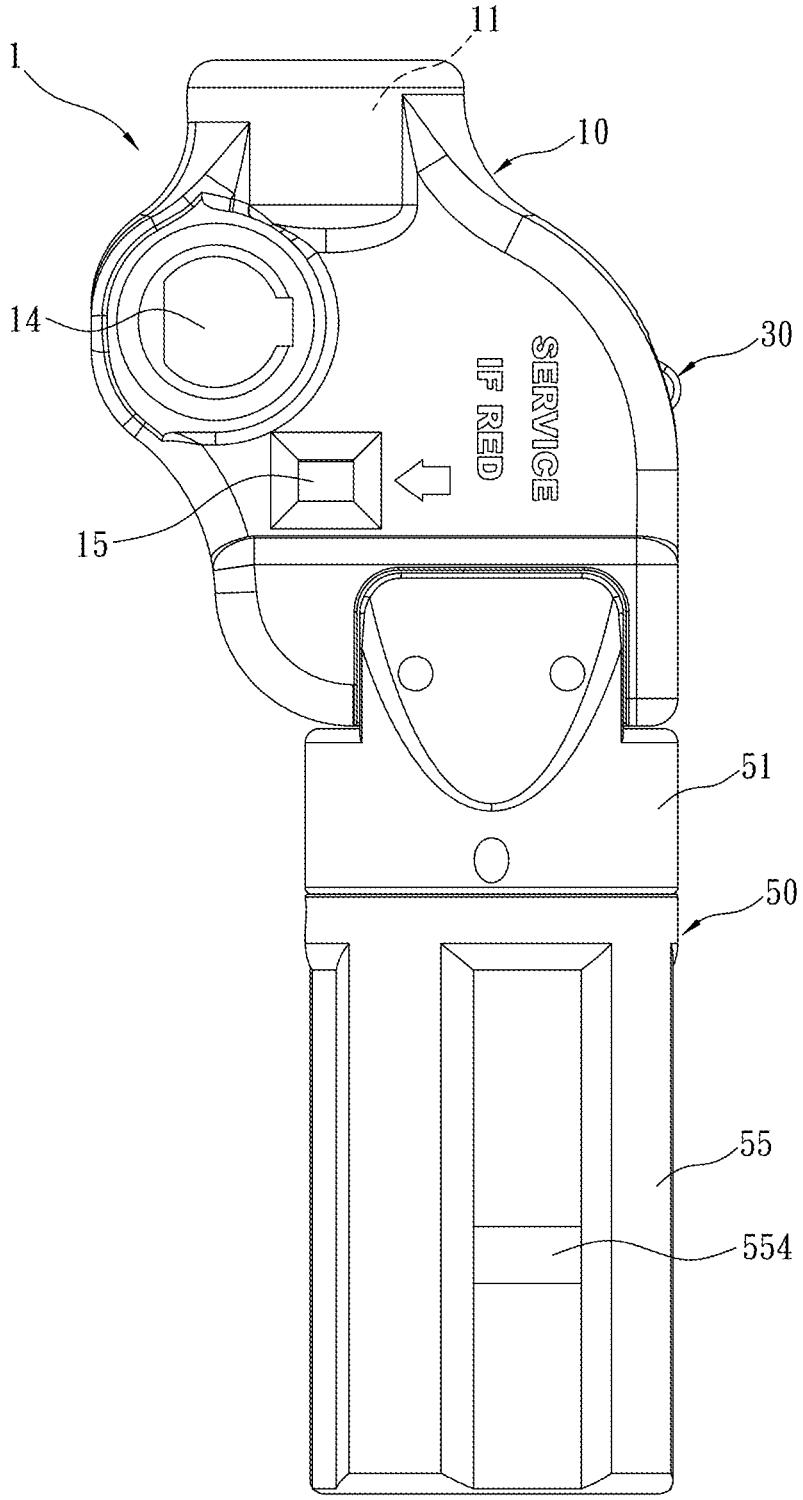
FIG. 12 is a perspective view of another embodiment according to the present invention.

Refer to FIG. 8, FIG. 9 and FIG. 10, how the inflator 1 of the present invention is manually operated is shown. As show in FIG. 8, it shows the state of the inflator 1 before use. The first end 301 of the transmission arm 30 is against the bottom surface of the movable seat 28 and the first spring 23 is compressed. At the moment, the seal 41 of the gas cylinder 40 has not been pierced by the needle 21 of the needle-shaped shaft 20. And the color of the first color area 24 of the needle-shaped shaft 20 is displayed through the window 15 of the inflator body 10.

Refer to FIG. 9, it shows the inflator 1 in use. The transmission arm 30 is rotated counterclockwise (the arrow A indicates) to drive the movable seat 28 moving upward and pushing against the first spring 23. Thus the needle-shaped shaft 20 is further driven to move and the needle 21 thereof pierces the seal 41 of the gas cylinder 40. The compressed gas in the gas cylinder 40 is released and used for inflation. Now the color of the second color area 25 of the needle-shaped shaft 20 is shown through the window 15 of the inflator body 10.

As shown in FIG. 10, release the transmission arm 30 after the seal 41 of the gas cylinder 40 being pierced by the needle 21. The compressed first spring 23 is released. Due to elasticity, one end of the first spring 23 is elastically against the needle-shaped shaft 20 so as to keep the needle 21 stay on the seal 41 while the other end of the first spring 23 is elastically against the movable seat 28 to make the movable seat 28 move downward and push against the first end 301 of the transmission arm 30. Thus the transmission arm 30 is rotated in the opposite direction and moved back to the original position.

Figure 11:
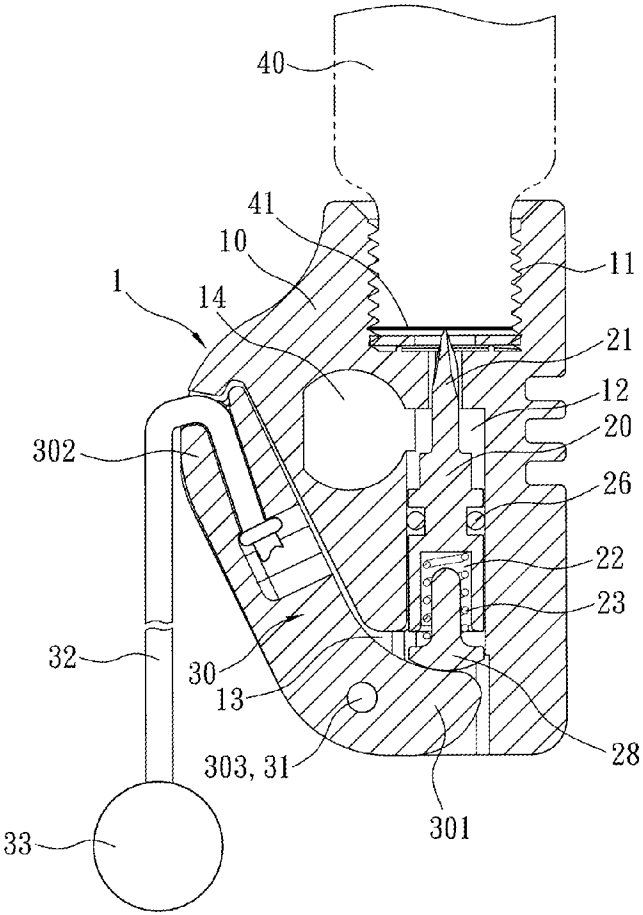
FIG. 11 is a schematic drawing showing the embodiment in FIG. 8 connected to a handle by a rope according to the present invention.

Refer to FIG. 11, the second end 302 of the transmission arm 30 is connected to a handle 33 by a rope 32. The transmission arm 30 is driven to rotate counterclockwise by pulling the handle 33 downward and the operation is more convenient.

Under manual operation of the inflator 1, how the inflator 1 works during rearming of the gas cylinder 40 is described in the following. The gas cylinder 40 is assembled with the cylinder housing 11 of the inflator body 10. When the needle 21 of the needle-shaped shaft 20 is against the seal 41 of the gas cylinder 40 and the needle-shaped shaft 20 is moving downward, the color of the first color area 24 is completely shown through the window 15 of the inflator body 10. This represents that the gas cylinder 40 has not been used yet and the inflator 1 can be used for inflation. Once the needle 21 of the needle-shaped shaft 20 has pierced the seal 41 of the gas cylinder 40 and the needle-shaped shaft 20 has not moved downward, the color of the second color area 25 is completely shown through the window 15 of the inflator body 10. This means that the gas cylinder has been used and a new gas cylinder 40 is required for using the inflator 1 to inflate.

In another embodiment of the present invention, an automatic actuating device is used for automatic operation of the inflator 1. Thus the inflator 1 can be operated manually/automatically and users have more options.

Refer from FIG. 12 to FIG. 26, an inflator of the present invention further includes an automatic actuating device 50 that is composed of an inner sleeve 51, a rod 52, a second spring 53, an ammunition mechanism 54 and an outer sleeve 55.

The inner sleeve 51 is disposed under the inflator body 10 and is communicating with a second channel 16 of the inflator body 10 axially. At least two slots 511 are arranged with a certain interval axially at the inner sleeve 51. A plurality of long grooves 512 is disposed on an inner wall of the inner sleeve 51 with an interval along the length direction of the inner sleeve 51. An inner top surface 513 of the inner sleeve 51 is extended downward to form a circular projecting neck 514. A threaded part 515 is set around on an outer surface of the inner sleeve 51. At least one assembly hole 516 corresponding to an assembly hole 17 of the inflator body 10 is mounted on an upper part of the inner sleeve 51. By at least one pin 18 being passed through the assembly holes 516, 517, of the inner sleeve 51 is assembled with the inflator body 10. Moreover, the inner sleeve 51 and the inflator body 10 can be integrally formed. The second channel 16 and the first channel 12 of the inflator body 10 are positioned in parallel with an interval. The width of the long grooves 512 can be modified for alignment and preventing misplacement.

The rod 52 is mounted axially in the inner sleeve 51. An upper part of the rod 52 is inserted into the second channel 16 of the inflator body 10 and is moveable along the length direction of the second channel 16. A long hole 521 is disposed axially on an upper part of the rod 52, allowing the second end 302 of the transmission arm 30 to pass through and move along the length direction thereof. A circular stopping part 522 is projecting from a lower part of the rod 52 while a circular groove 523 is mounted on a middle part of the rod 52 and a projecting flange 524 is disposed under the circular groove 523. A seal ring 56 is mounted in the circular groove 523 and is against the inner wall of the circular projecting neck 514 of the inner sleeve 51 to achieve sealing. A plurality of projecting bodies 525 corresponding to and locked with the long grooves 512 is radially arranged on the projecting flange 524.

The second spring 53 is arranged around the rod 52. One end of the second spring 53 is elastically leaning against the inner top surface 513 of the inner sleeve 51 while the other end thereof is elastically leaning against a top surface of the projecting flange 524 of the rod 52.

The ammunition mechanism 54 is mounted in the inner sleeve 51 and is located under the rod 52. The ammunition mechanism 54 consists of a base 541, a plurality of elastic pieces 542 and a circular wall 543. A round hole 544 penetrating the base 541 is disposed on a center of the base 541 and the elastic pieces 542 are arranged evenly in the round hole 544 of the base 541 and is projecting a predetermined height from the round hole 544. A bottom end of each elastic piece 542 is connected to the base 541 while a top end of the elastic piece 542 is disposed with a stopping surface 545 that is against the stopping part 522 of the rod 52. The circular wall 543 is wrapped around the elastic piece 542 and is arranged at the top surface of the base 541 so as to restrict the elastic pieces 542 and prevent the elastic piece 542 from radial elastic deformation caused by axial pushing force from upward. The circular wall 543 is dissolved after in contact with aqueous solution. Corresponding to the slots 511 and the long grooves 512 of the inner sleeve 51, the base 541 is radially disposed with at least two convex bodies 546 and a plurality of convex bodies 547. The convex body 546 is locked with the slot 511 while the convex body 547 is locked with the long groove 512 correspondingly. The convex bodies 546, 547 of the ammunition mechanism 54 and the slots 511 as well as the long grooves 512 of the inner sleeve 51 provide guidance and alignment while assembling the ammunition mechanism 54 with the inner sleeve 51 so as to prevent errors during rearming of the ammunition mechanism 54. When the ammunition mechanism 54 is mounted in the inner sleeve 51, the stopping surface 545 of the elastic piece 542 is against the stopping part 522 of the rod 52 and the elastic pieces 542 are stopped by the circular wall 543. Thus the rod 52 will not move downward even under the action of elasticity of the second spring 53.

Figure 13:
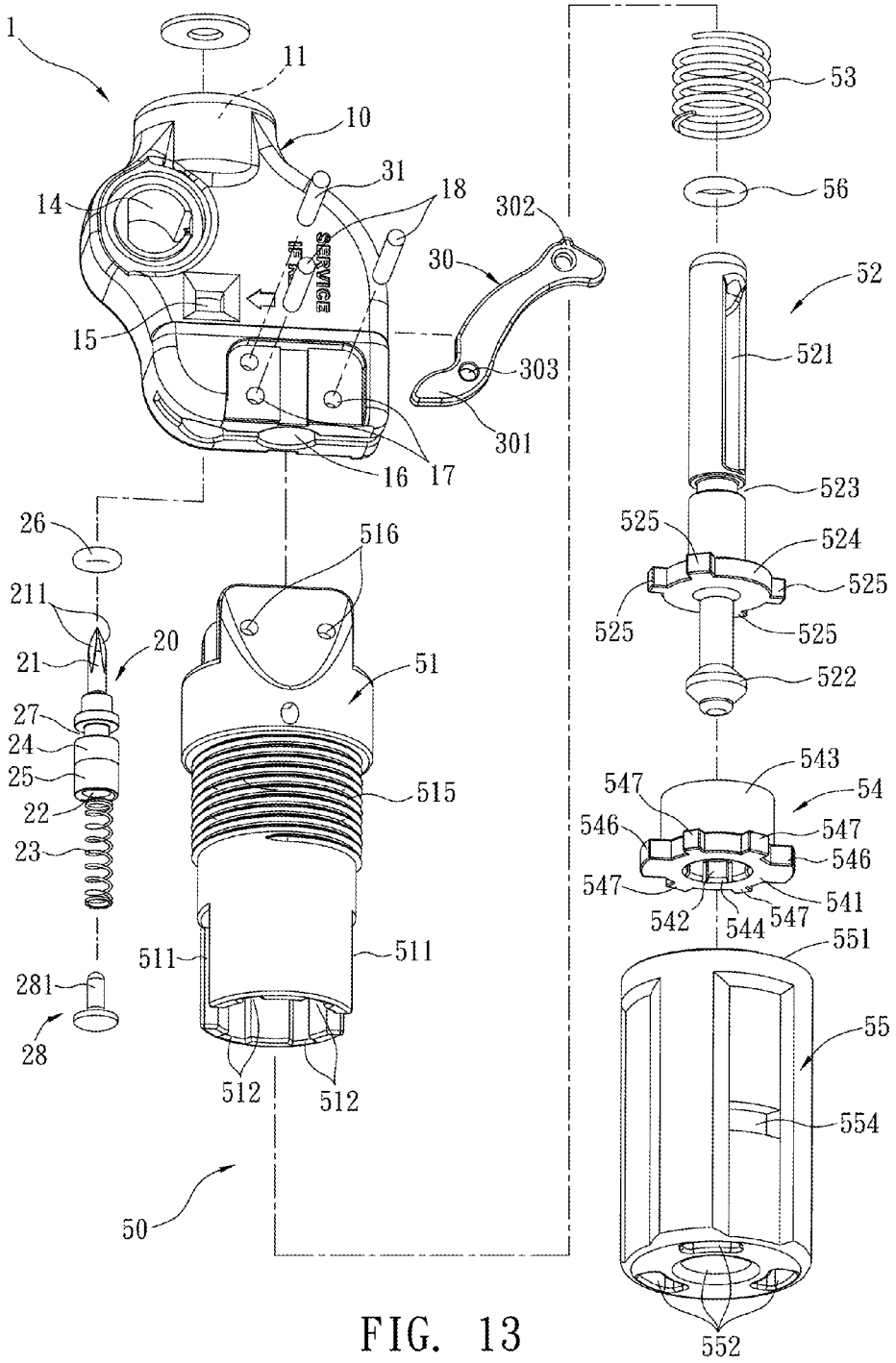
FIG. 13 is an explosive view of another embodiment according to the present invention.
Figure 14:
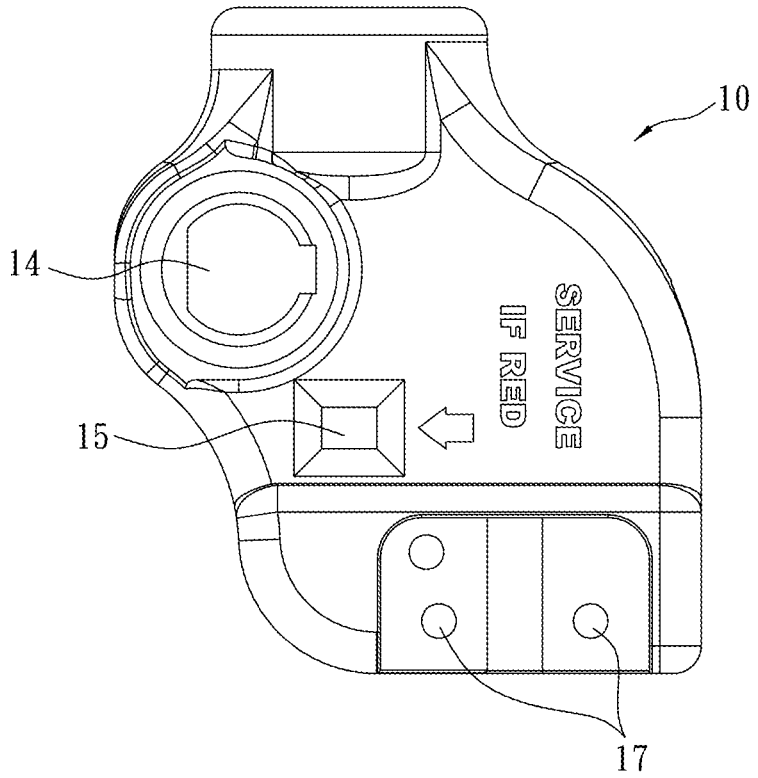
FIG. 14 and FIG. 15 are a front view and a front cross sectional view of an inflator body respectively of another embodiment according to the present invention.
Figure 15:
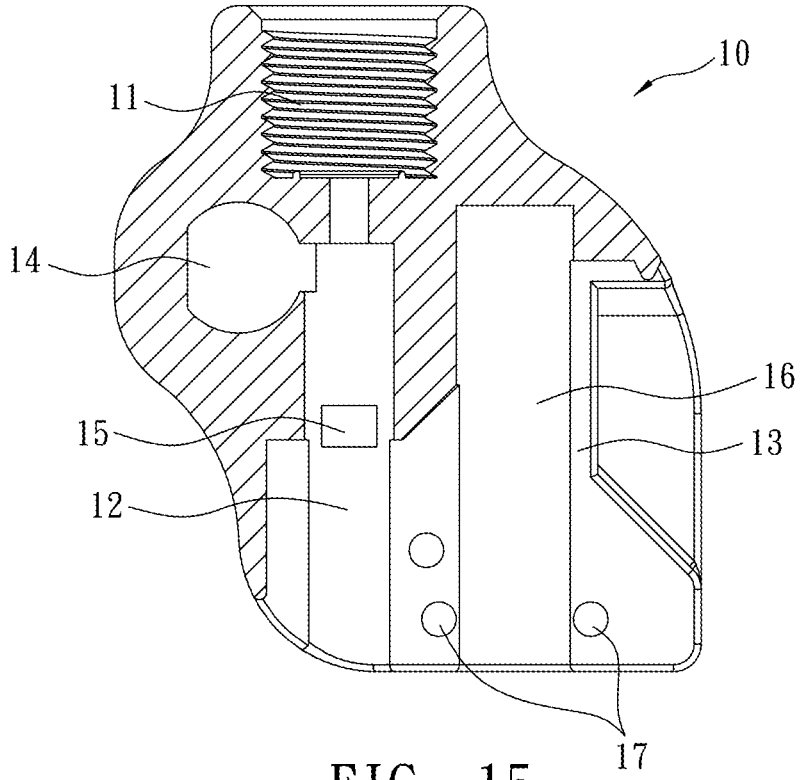
Figure 16:
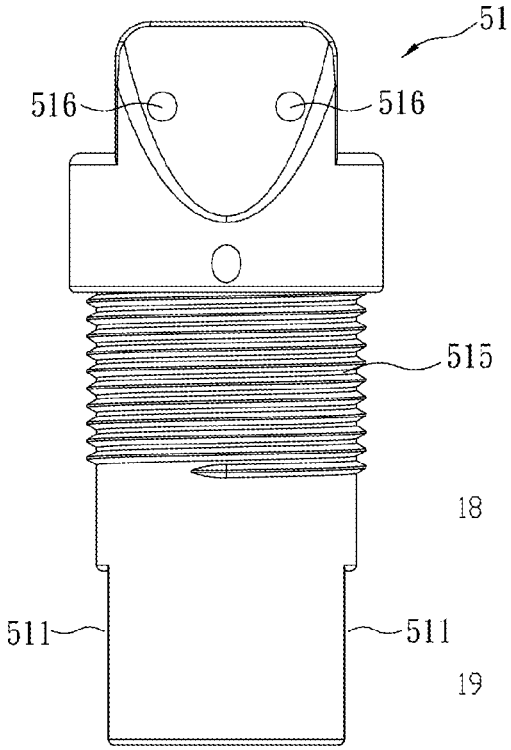
FIG. 16, FIG. 17, FIG. 18, FIG. 19 and FIG. 20 are a front view, a side view, a longitudinal cross sectional view and two transverse cross sectional views of another embodiment according to the present invention.
Figure 17:
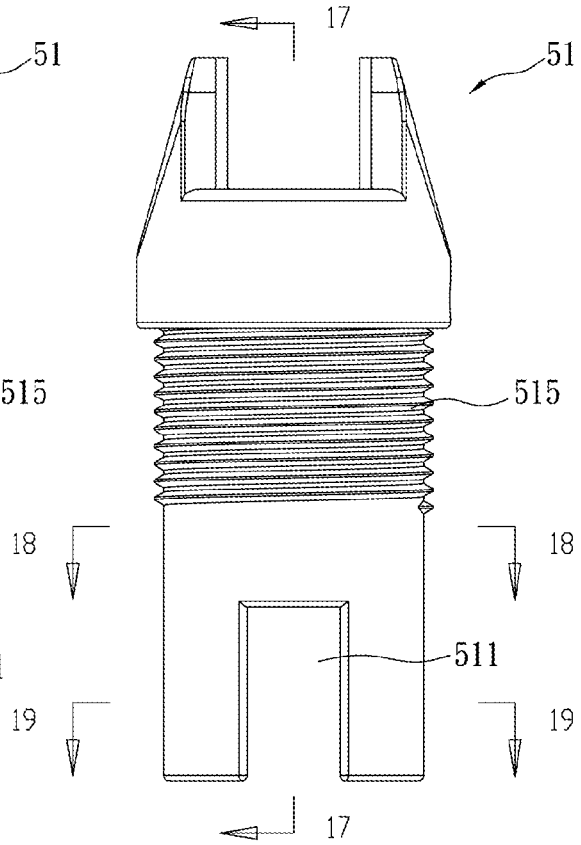
Figure 18:
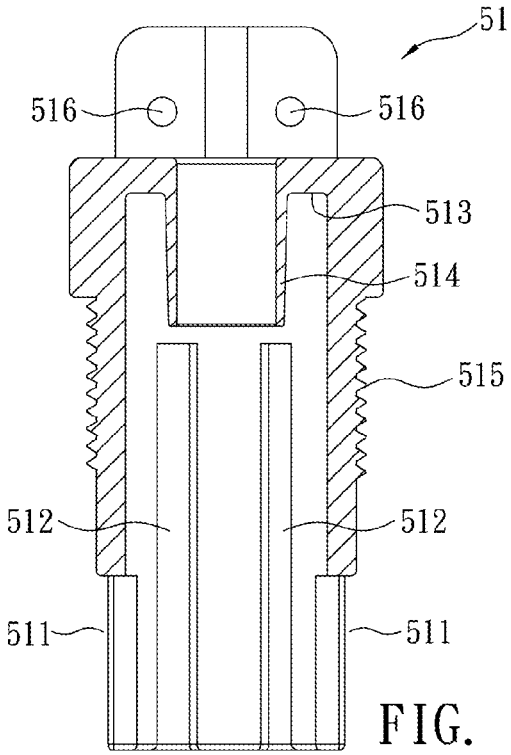
Figure 19:
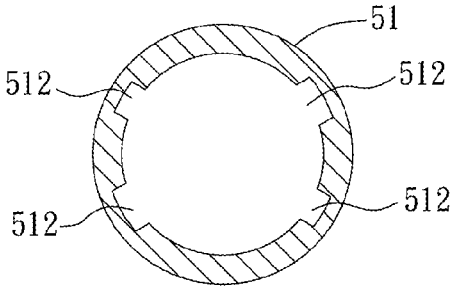
Figure 20:
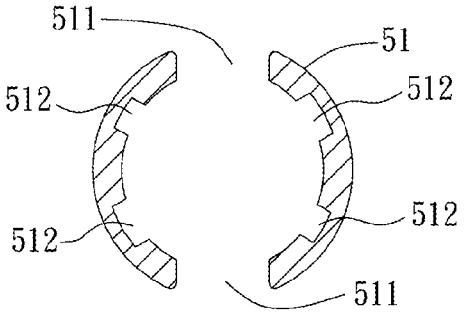
Figure 21:
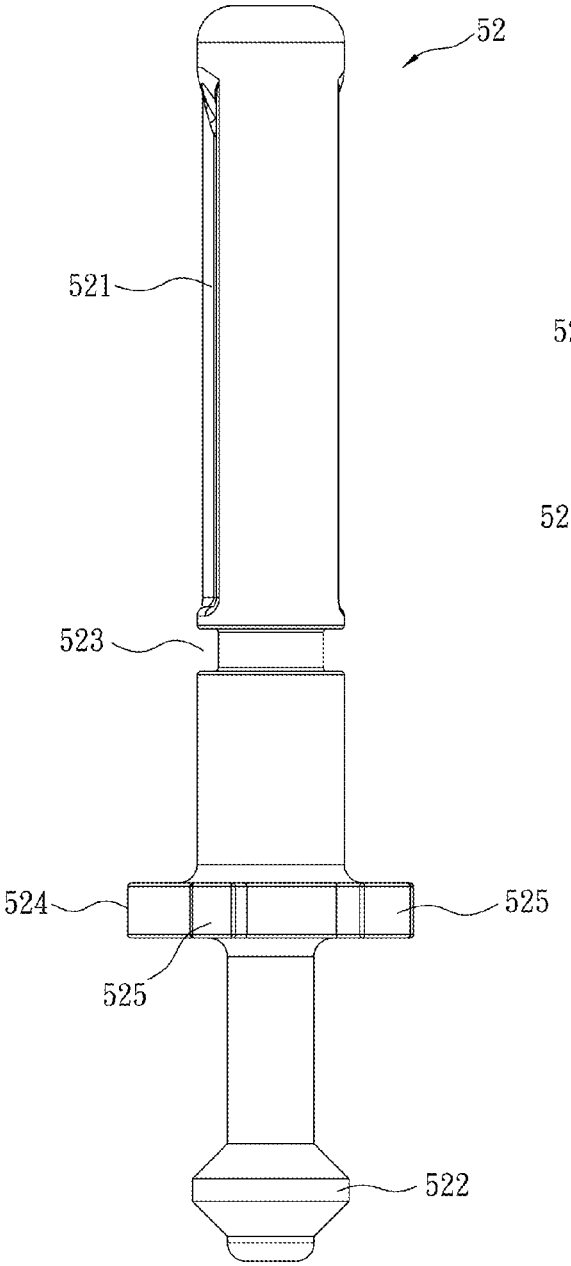
FIG. 21 and FIG. 22 are a front view and a top view of a rod of another embodiment according to the present invention.
Figure 22:
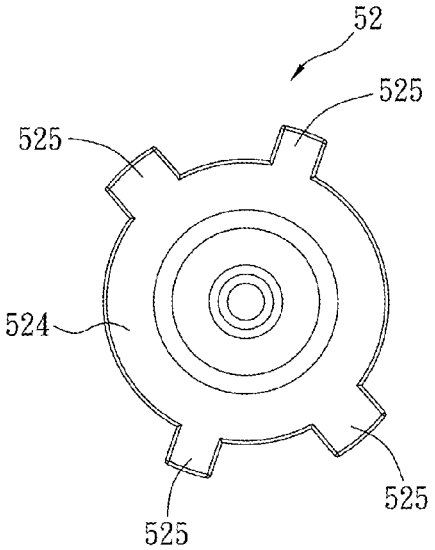
Figure 23:
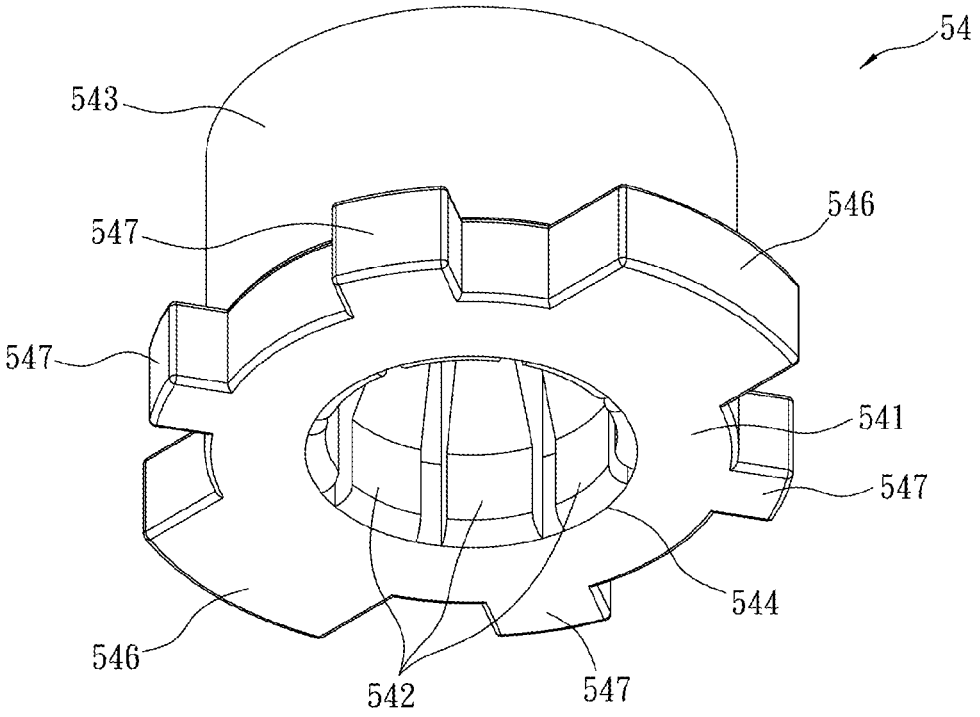
FIG. 23 and FIG. 24 are a perspective view and a longitudinal cross sectional view of an ammunition mechanism of another embodiment according to the present invention.
Figure 24:
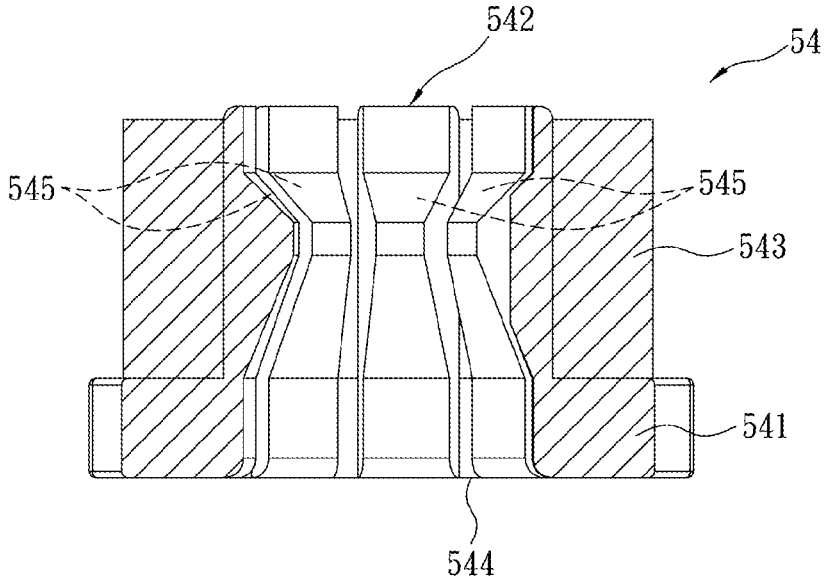
Figure 25:
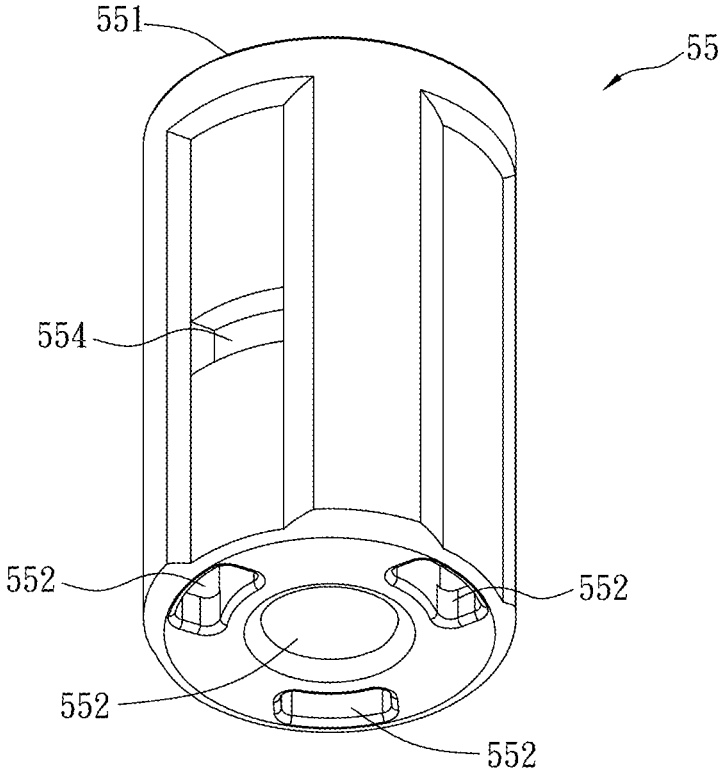
FIG. 25 and FIG. 26 are a perspective view and a longitudinal cross sectional view of an outer sleeve of another embodiment according to the present invention
Figure 26:
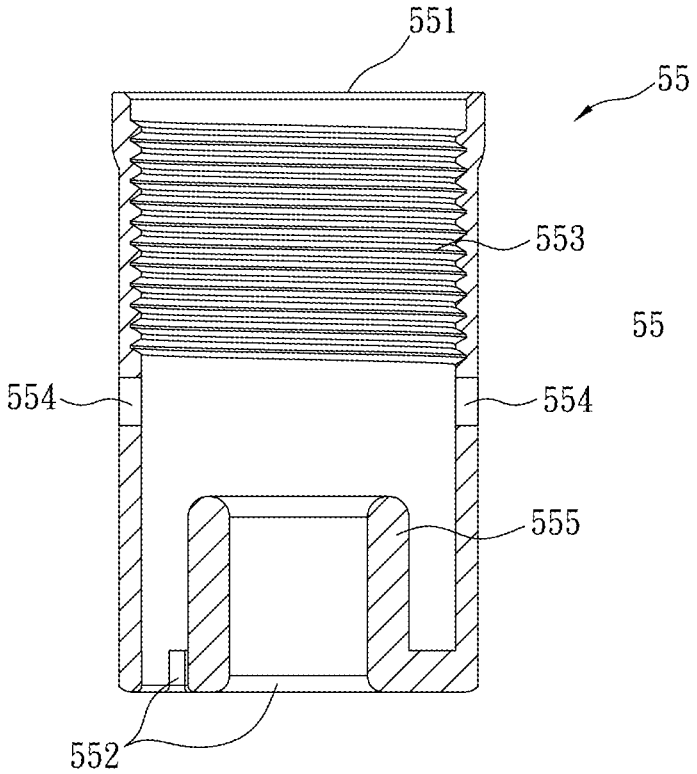

As shown in FIG. 25 and FIG. 26, the outer sleeve 55 is arranged around the inner sleeve 51 and having an opening 551 at one end while the other end thereof is disposed with a plurality of first water supply/vent hole 552. A threaded part 553 corresponding to the threaded part 515 of the inner sleeve 51 is disposed inside the opening 551 of the outer sleeve 55. Although the outer sleeve 55 and the inner sleeve 51 in this embodiment are connected by thread parts 553, 515 engaged with each other, the connection way is not limited by threaded parts. The outer sleeve 55 and the inner sleeve 51 can also be fastened to each other. An inner surface of the bottom of the outer sleeve 55 is extended upward to form a projecting neck 555. When the outer sleeve 55 and the inner sleeve 51 are assembled with each other, the projecting neck 555 of the outer sleeve 55 is against the bottom of the base 541 of the ammunition mechanism 54. The size of the first water supply/vent hole 552 is not limited. For example, the first water supply/vent hole 552 in the center in FIG. 13 is in a larger size while other first water supply/vent hole 552 arranged circularly is in a smaller size. The arrangement way of the first water supply/vent hole 552 is also not restricted. At least one second water supply/vent hole 554 is disposed on an outer surface of the outer sleeve 55.

Under the automatic operation of the inflator 1, how the inflator 1 works during rearming of the gas cylinder 40 is described in the following. The steps are similar to those of the manual-operated inflator 1 but the difference is in that the ammunition mechanism 54 needs to be replaced. First disassemble the outer sleeve 55 of the automatic actuating device 50. Then replace the used ammunition mechanism 54 with a new one. While assembling the new ammunition mechanism 54, the convex bodies 546, 547 on the base 541 of the ammunition mechanism 54 are locked with the slots 511 and the long grooves 512 of the inner sleeve 51 respectively. Then push the ammunition mechanism 54 inward until the stopping surface 545 of the elastic piece 542 of the ammunition mechanism 54 is against the stopping part 522 of the rod 52. Next put the outer sleeve 55 back in place and the rod 52 is moved upward during the put-back process. At the same time, the second end 302 of the transmission arm 30 turns back to the original position due to elasticity of the first spring 23.

Figure 27:
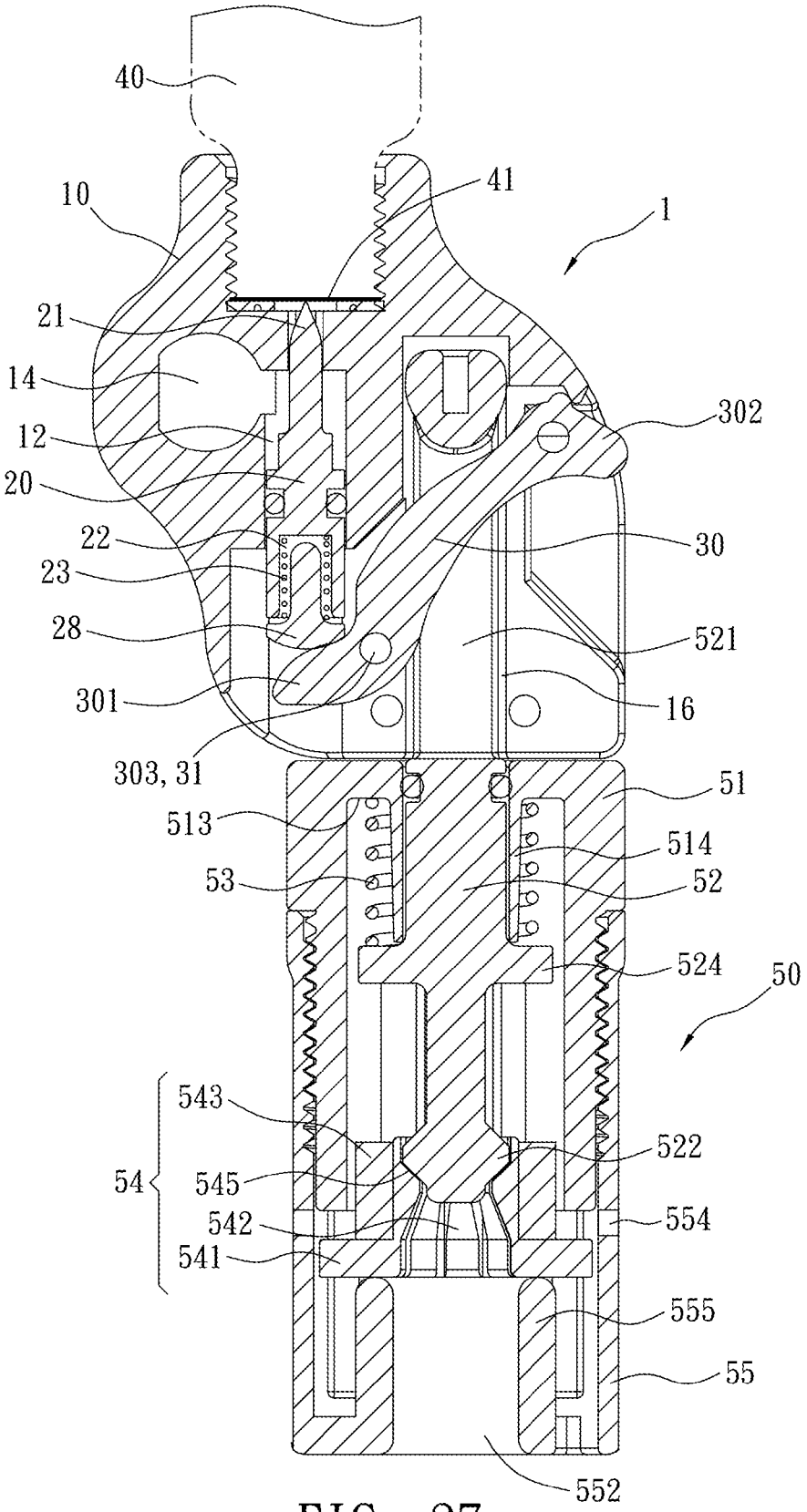
FIG. 27 and FIG. 28 are front cross sectional view of another embodiment showing how the inflator works according to the present invention.
Figure 28:
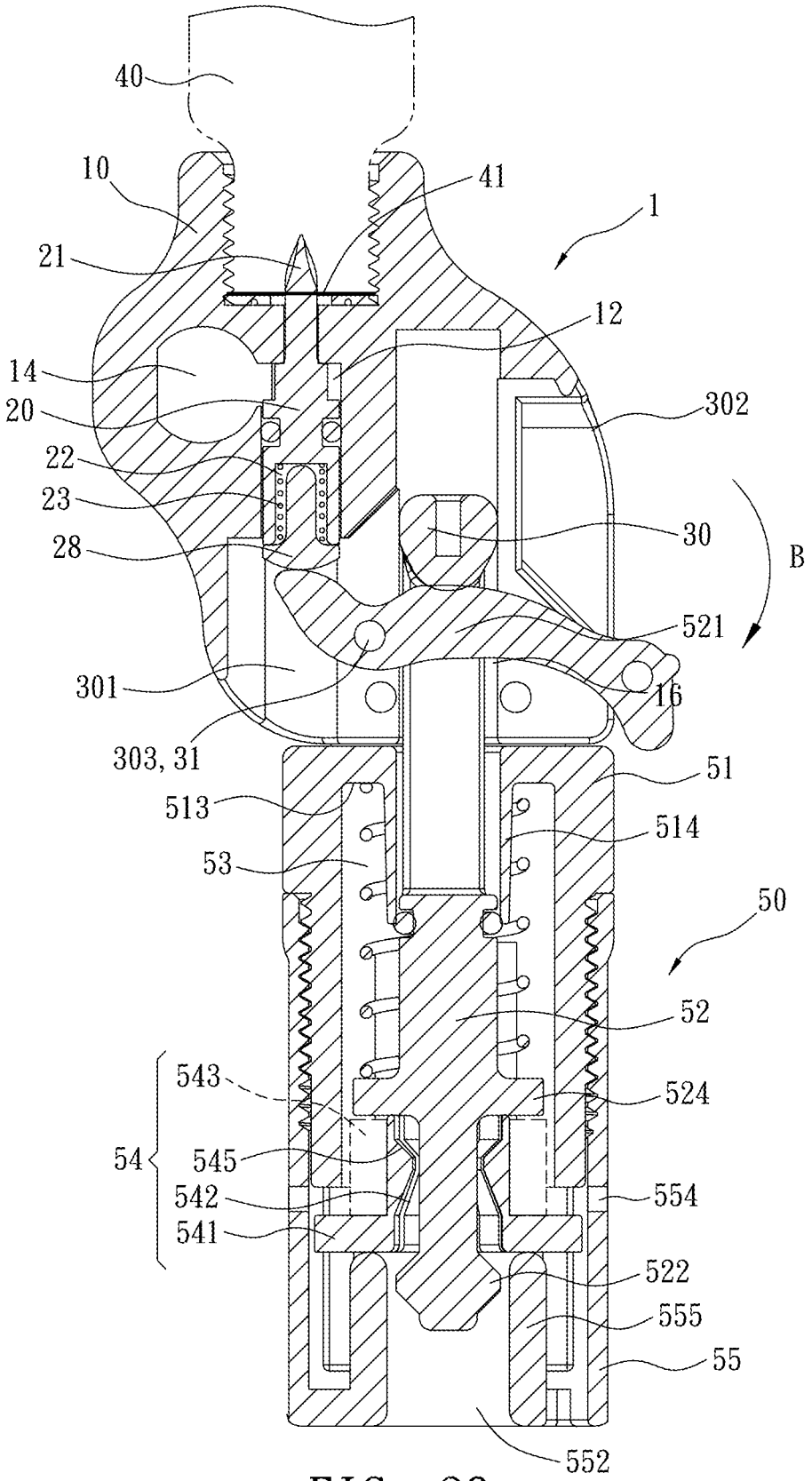

Refer to FIG. 27 and FIG. 28, the inflator 1 of the present invention is in the automatic operation mode and the inflator 1 is used to inflate automatically. When aqueous solution passes the first water supply/vent hole 552 and/or the second water supply/vent hole 554 of the outer sleeve 55 and enters the inner sleeve 51, the circular wall 543 of the ammunition mechanism 54 is dissolved after in contact with the aqueous solution and the elastic restriction on the elastic piece 542 is released. By elasticity of the elastic pieces, the second spring 53 is against and pushing the projecting flange 524 of the rod 52 downward to make the rod 52 move downward. Thus the stopping part 522 of the rod 52 pushes against the elastic piece 542 of the ammunition mechanism 54 and the elastic piece 542 is bent outward to enter the round hole 544 of the base 541 until the projecting flange 524 is against an upper part of the elastic piece 542. During the process, the inner top surface of the long hole 521 of the rod 52 is against the second end 302 of the transmission arm 30 so that the transmission arm 30 is driven to rotate clockwise around the pivot shaft 31, as the arrow B indicates in FIG. 28. Then the first end 301 of the transmission arm 30 is moved upward to push against the movable seat 28. Thus the needle-shaped shaft 20 is further driven to move upward and toward the cylinder housing 11 of the inflator body 10 so as to pierce the seal 41 of the gas cylinder 40. The compressed gas in the gas cylinder 40 is flowing through the first channel 12 and the through hole 14 of the inflator body 10 and entering an object (not shown in figure) to be inflated. Thereby the inflator 1 works automatically.

Figure 29:
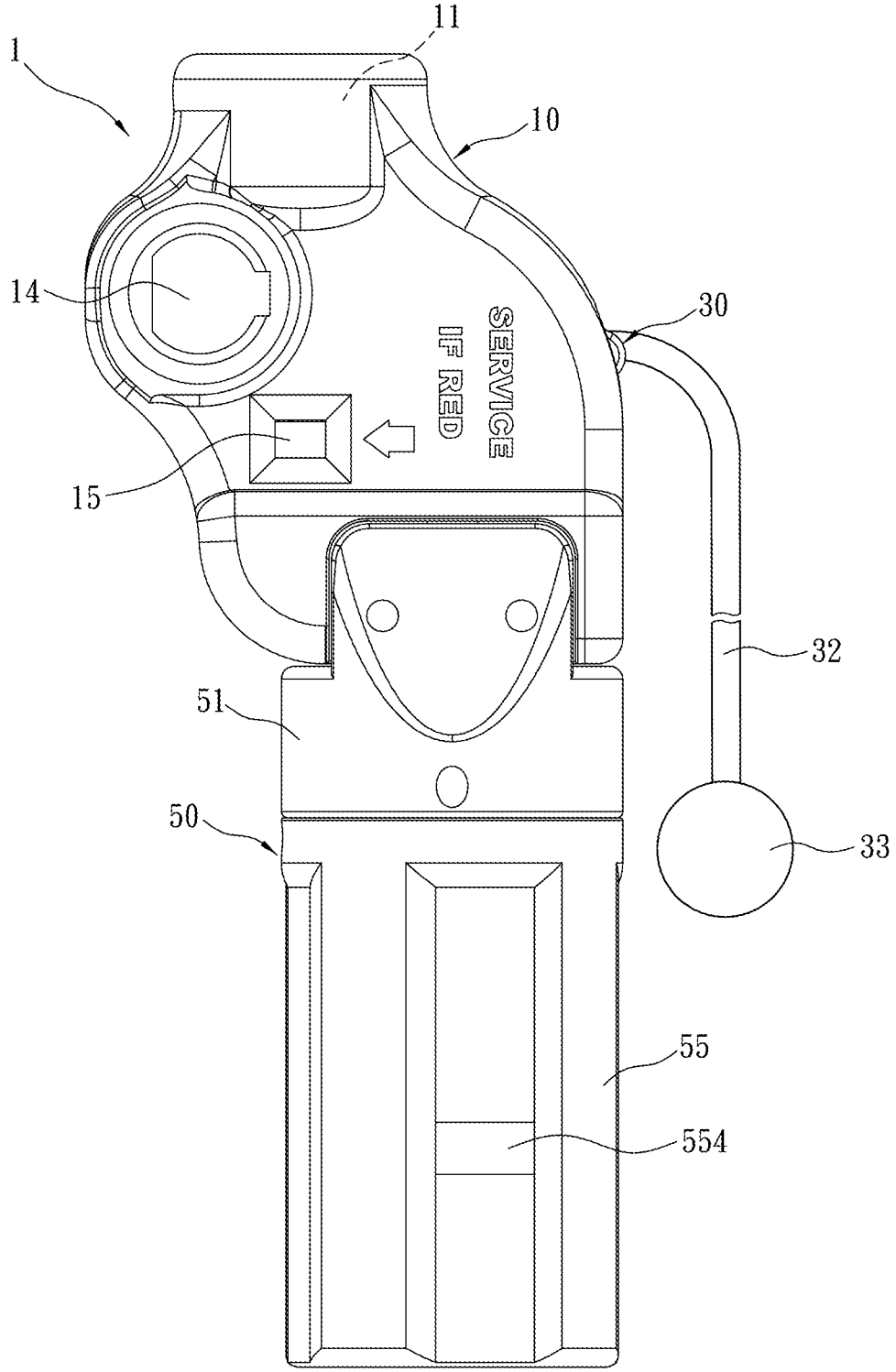
FIG. 29 is a schematic drawing showing the embodiment in FIG. 12 connected to a handle by a rope according to the present invention.

In summary, the inflator 1 can be operated manually, automatically, or both on the same inflator 1, as shown in FIG. 29. Users have more choices (options).

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An inflator comprising:

an inflator body having a cylinder housing disposed on a top surface thereof for mounting a gas cylinder, a first channel and a chamber therein, and a through hole penetrating the inflator body for inflation and arranged at a side surface thereof;

a needle-shaped shaft that is moveable along a length direction of the first channel of the inflator body; and a transmission arm that is pivotally disposed on the chamber of the to inflator body;

wherein a window is disposed on at least one of two sides of the inflator body;

wherein a first color area and a second color area are arranged around the needle-shaped shaft and corresponding to the windows of the inflator body respectively; the first color area and the second color area have different colors to represent different states of the inflator; a conical needle is disposed on a top end of the needle-shaped shaft while a spring and a movable seat are disposed in turn on a lower part of the needle-shaped shaft; at least one slot is arranged at a surface of the needle while a top end of the first spring is leaning against a bottom surface of the needle-shaped shaft and a bottom end of the first spring is leaning against a top surface of the movable seat; a bottom surface of the movable seat is against one end of the transmission arm;

wherein the one end of the transmission arm drives the movable seat to move upward and push against the first spring when the transmission arm is rotated counterclockwise; thus the needle-shaped shaft is further driven to move upward and the color of the second color area is shown through the window of the inflator body; while the transmission arm is being released, one end of the first spring is elastically against the needle-shaped shaft so as to keep the needle upward and the other end of the first spring is elastically against the movable seat for driving the transmission arm to rotate in opposite direction and turn back.

2. The device as claimed in claim 1, wherein a seal ring is arranged around the needle-shaped shaft, located between the needle and the first color area and mounted in a groove; the seal ring is against an inner wall of the first channel of the inflator body.

3. The device as claimed in claim 1, wherein the first color area and the second color area are arranged adjacent to each other.

4. The device as claimed in claim 1, wherein the colors of the first color area and the second color area are formed on the needle-shaped shaft by spray, electroplating or coating.

5. The device as claimed in claim 1, wherein the needle-shaped shaft is disposed with a first concave area and a second concave area; the first concave area and the second concave area are arranged with a first covering body and a second covering body respectively; the first covering body having the color of the first color area and the second coveting body having the color of the second color area.

6. The device as claimed in claim 1, wherein a space with an opening facing downward for receiving the first spring is arranged at a lower end of the needle-shaped shaft.

7. The device as claimed in claim 1, wherein a projecting pin is projecting downward from the bottom surface of the needle-shaped shaft; the projecting pin is mounted in the top end of the first spring.

8. The device as claimed in claim 1, wherein a projecting pin is arranged at the top surface of the moveable seat; the projecting pin is mounted in the bottom end of the first spring.

9. The device as claimed in claim 1, wherein a space with an opening facing upward for receiving the first spring is arranged at the top surface of the movable seat.

10. The device as claimed in claim 1, wherein the color of the first color area of the needle-shaped shaft represents a non-inflated state.

11. The device as claimed in claim 1, wherein the color of the second color area represents an already-inflated state.

12. The device as claimed in claim 1, wherein the inflator further includes an automatic actuating device having an inner sleeve that is disposed under the inflator body and is communicating with a second channel of the inflator body axially; the second channel and the first channel of the inflator body are arranged in parallel with an interval; an inner top surface of the inner sleeve is extended downward to form a circular projecting neck;

a rod that is mounted in the inner sleeve; a long hole is disposed axially on an upper part of the rod, allowing the other end of the transmission arm 30 to pass through; the upper part of the rod with the long hole is inserted into the second channel of the inflator body and is moveable along a length direction of the second channel; a circular stopping part is projecting from a lower part of the rod while a projecting flange is disposed on a middle part of the rod;

a second spring that is arranged around the rod and one end of the second spring is elastically leaning against the inner top surface of the inner sleeve while the other end thereof is elastically leaning against a top surface of the projecting flange of the rod;

an ammunition mechanism mounted in the inner sleeve, located under the rod and having a base with a penetrating round hole disposed on a center thereof, a plurality of elastic pieces that is arranged evenly in the round hole of the base and is projecting a predetermined height from the round hole; a bottom end of each elastic piece is connected to the base while the elastic pieces are corresponding to the stopping part of the rod and a top end of the elastic piece is disposed with a stopping surface that is against the stopping part;

a circular wall that is wrapped around the elastic piece and is arranged at a top surface of the base so as to restrict the elastic pieces and prevent the elastic piece from radial elastic deformation caused by an upward axial pushing force; the circular wall is dissolved after being in contact with aqueous solution; and an outer sleeve having an opening at one end while the other end thereof is disposed with a plurality of first water supply/vent hole and at least one second water supply/vent hole is disposed on an outer surface of the outer sleeve; the outer sleeve is arranged around the inner sleeve through the opening; an inner surface of a bottom of the outer sleeve is extended upward to form a projecting neck; the projecting neck of the outer sleeve is against a bottom of the base of the ammunition mechanism when the outer sleeve and the inner sleeve are assembled with each other;

wherein the circular wall of the ammunition mechanism is dissolved after being in contact with the aqueous solution and elastic restriction on the elastic pieces is released when aqueous solution passes the first water supply/vent hole and/or the second water supply/vent hole of the outer sleeve and enters the inner sleeve; by elasticity of the elastic pieces, the second spring is against and pushing the projecting flange of the rod downward to make the rod move downward; thus an inner top surface of the long hole is against the transmission arm and the transmission arm is driven to rotate clockwise, and push upward against the movable seat; the first spring is further compressed to drive the needle-shaped shaft moving upward and the color of the second color area is displayed through the window of the inflator body.

13. The device as claimed in claim 12, wherein at least two slots are arranged with a certain interval axially at the inner sleeve and a plurality of long grooves is disposed on an inner wall of the inner sleeve with an interval; a plurality of projecting bodies corresponding to and locked with the long grooves is radially arranged on the projecting flange of the rod.

14. The device as claimed in claim 12, wherein the inner sleeve and the inflator body are integrally formed.

15. The device as claimed in claim 13, wherein the base is radially disposed with at least two convex bodies corresponding to and locked with the slots of the inner sleeve respectively.

16. The device as claimed in claim 13, wherein the base is radially disposed with a plurality of convex bodies corresponding to and locked with the long grooves of the inner sleeve respectively.

* * * * *